United States Patent [19]

Long

[11] Patent Number: 4,932,146

[45] Date of Patent: Jun. 12, 1990

[54] ADJUSTABLE FRAMING CLAMP

[76] Inventor: M. Thomas Long, 739 S. Chester Rd., Swarthmore, Pa. 19081-2795

[21] Appl. No.: 208,745

[22] Filed: Jun. 17, 1988

[51] Int. Cl.[5] ..... A47G 1/06; G09F 1/12

[52] U.S. Cl. ..... 40/156

[58] Field of Search ..... 40/152, 152.1; 156; 52/767, 768, 127.6, 127.8

[56] References Cited

U.S. PATENT DOCUMENTS

| | | | |
|---|---|---|---|
| 509,626 | 11/1893 | Patterson . | |
| 796,838 | 8/1905 | Fraser | 40/156 |
| 908,608 | 1/1909 | Pullen . | |
| 1,059,764 | 4/1913 | Ringer . | |
| 2,489,477 | 11/1946 | Brecher . | |
| 2,744,346 | 5/1956 | Auerbach-Levy . | |
| 3,146,502 | 9/1962 | Reiss et al. . | |
| 3,596,392 | 8/1971 | Vani | 40/156 |
| 3,665,629 | 5/1972 | Shore | 40/156 |
| 3,670,439 | 6/1972 | Shimizu | 40/156 |
| 3,769,730 | 11/1973 | Dole | 40/156 |
| 4,014,119 | 3/1977 | Teufel | 40/152 |
| 4,204,350 | 5/1980 | Brenner | 40/155 |
| 4,509,278 | 4/1985 | Astolfi | 40/156 |

FOREIGN PATENT DOCUMENTS

| | | | |
|---|---|---|---|
| 19382 | of 1909 | United Kingdom | 40/156 |

*Primary Examiner*—Cary E. Stone

*Attorney, Agent, or Firm*—Charles H. Lindrooth; D. Stuart McFarlin

[57] ABSTRACT

A stepped frame having at least a pair of substantially planar surfaces oriented one lower than the other has a device for clamping a removable panel to the lower surface. One end of a rigid, unitary member attaches to the upper surface of the frame, while the other end extends over the panel, which in turn rests against the lower surface of the frame. A threaded aperture in the extending end, and a correspondingly threaded clamping screw cooperate to exert pressure on the panel when the screw is positively threaded through the aperture, thereby clamping the panel to the frame.

2 Claims, 3 Drawing Sheets

ADJUSTABLE FRAMING CLAMP

FIELD OF THE INVENTION

This invention relates to devices for securely fastening panels within stepped frames and in particular to rigid clamping devices that attach to the raised portion of the frame and exert a downward pressure on the panel to effectuate the clamping of the panel to the lower portion of the frame. Although not limited thereto, the invention is particularly directed to clamping devices for securing panels within decorative display frames such as picture frames.

BACKGROUND OF THE INVENTION AND PRIOR ART

Clamping devices are known which utilize a resilient member affixed at one end to an outer frame, while the opposite end extends over the panel to be secured within the frame. The member is oriented with the extending portion in intimate contact with the panel, its resiliency causing the member to press against the panel, thereby holding the panel within the frame. The device may be made from a plurality of materials, with the portion that attaches to the frame being rigid and only the extending portion being resilient. The resiliency of these devices allows for a limited amount of adjustability to accommodate some difference between the height of the panel and the frame. Because of this resiliency, however, such devices are somewhat limited in clamping strength, and tend to be rather flimsy.

Clamping devices can also be constructed entirely of rigid materials. Because of their rigidity, such devices are able to accommodate only a narrow range of relationships between the relative height of the panel to the frame.

OBJECTS AND ADVANTAGES OF THE INVENTION

An important object of the invention is to securely clamp a panel to the lower surface of a stepped frame with the clamping strength being independent of variations in the location of the upper panel surface relative to the upper surface of the frame.

Another object of the invention is to produce a clamping device having a rigid, unitary construction.

A still further object of the invention is to produce a reversible clamping device which can be attached to the frame in either of two discrete orientations; one orientation can accommodate relatively thick panels or multiple panels and the other orientation can accommodate relatively thin panels.

A still further object of the invention is to produce a clamping device that can be readily attached and released.

A still further object of the invention is to produce a clamping device with variable clamping force that can be readily and accurately adjusted.

A still further object of the invention is to produce a clamping device that can be used effectively with a wide variety of conventional frames.

These objects of the invention are achieved by a rigid member having oppositely disposed planar portions connected by a bent intermediate section, means for attaching one planar portion to the frame with the other planar portion extending over the panel to be secured within the frame, a threaded aperture in the extending planar portion, and a cylindrical member threadedly received within the aperture so that by being threaded through the aperture, the cylindrical member engages the panel, thereby securing the panel within the frame.

Other objects and advantages will become apparent from the following detailed description of a preferred embodiment of the invention.

DETAILED DESCRIPTION OF THE INVENTION

Figure 1:
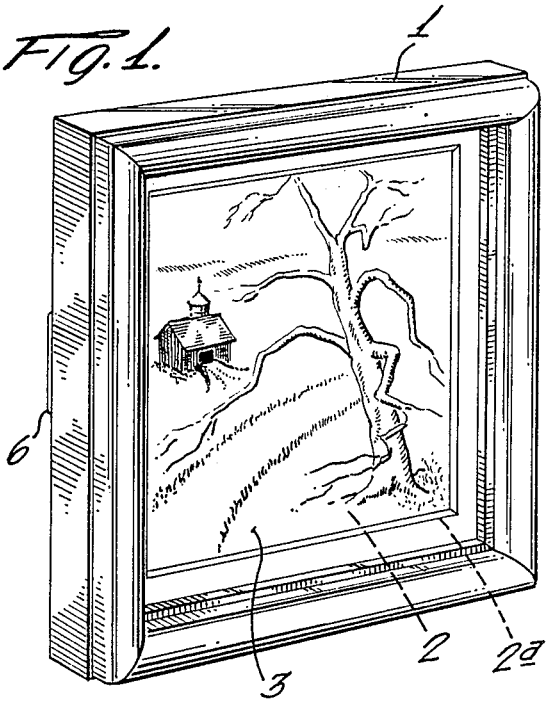
FIG. 1 is a front view of a picture frame equipped with a clamping device made according to the invention.
Figure 3:
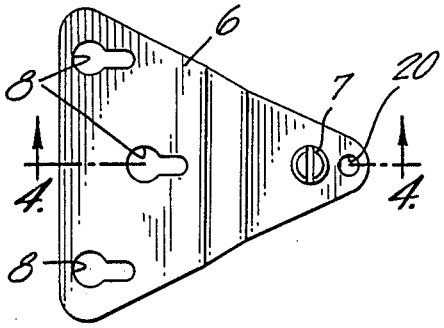
FIG. 3 is an elevational view of a clamping device showing three apertures at one end for receiving means for attaching the device to a frame, and two apertures at the opposite end, one of which has received therein a threaded member for making contact with the panel to be secured to the frame.
Figure 5:
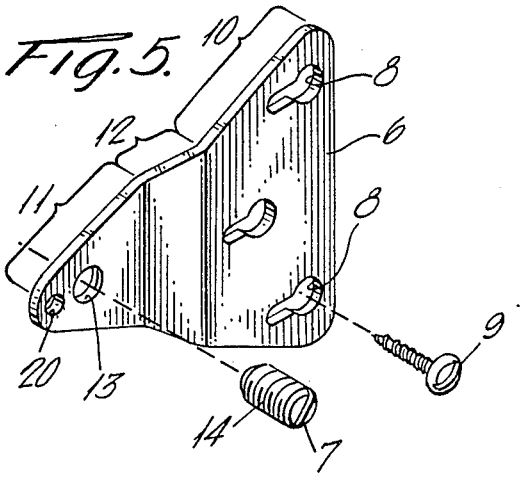
FIG. 5 is an oblique exploded view of a clamping device showing the unitary securing member and the several apertures therein, the threaded clamping member which contacts the panel to be secured, and a screw means for attaching the securing member to the frame.
Figure 4:
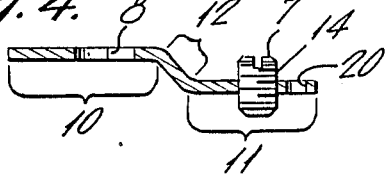
FIG. 4 is a sectional view taken on line 4—4 of FIG. 3 showing a bent intermediate section of the securing member with the sections on either side of the bend residing in substantially parallel planes.
Figure 6:
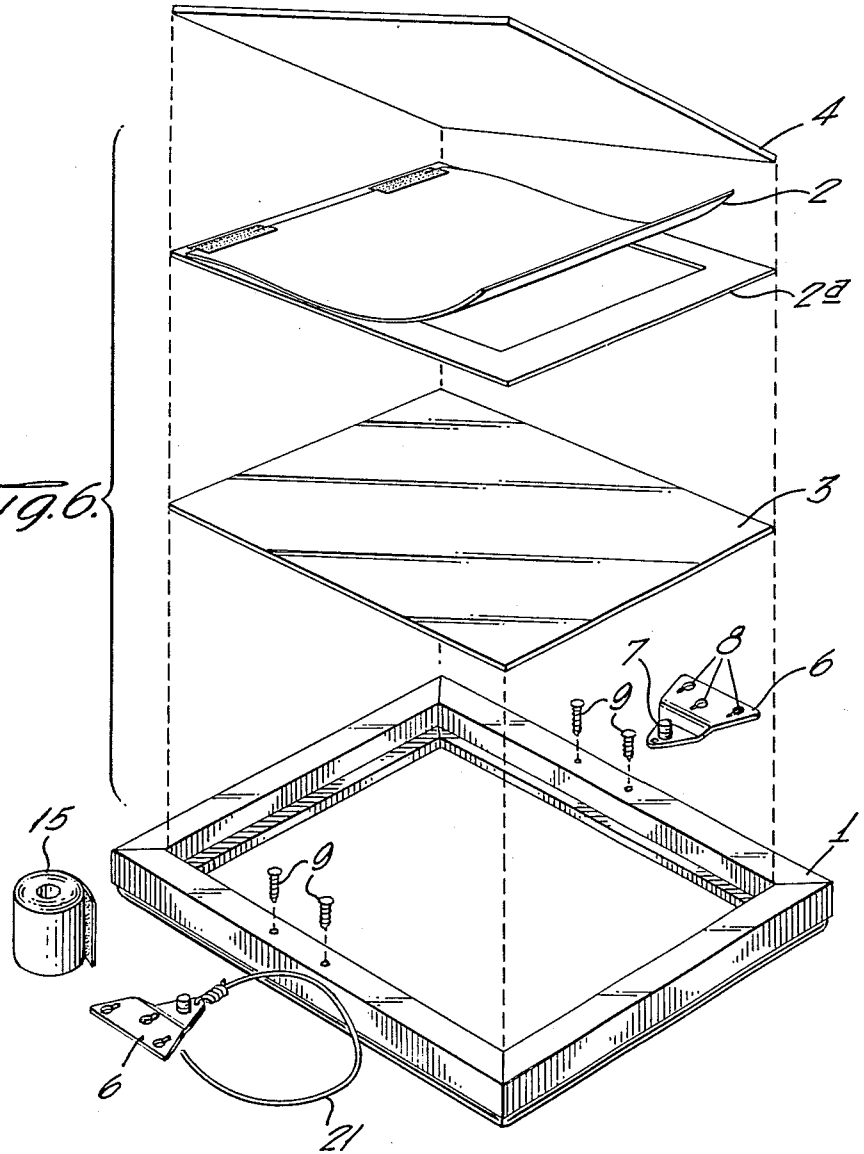
FIG. 6 is an exploded view of a decorative display which is to be secured in a frame by a panel held in place by the inventive clamping device.
Figure 8:
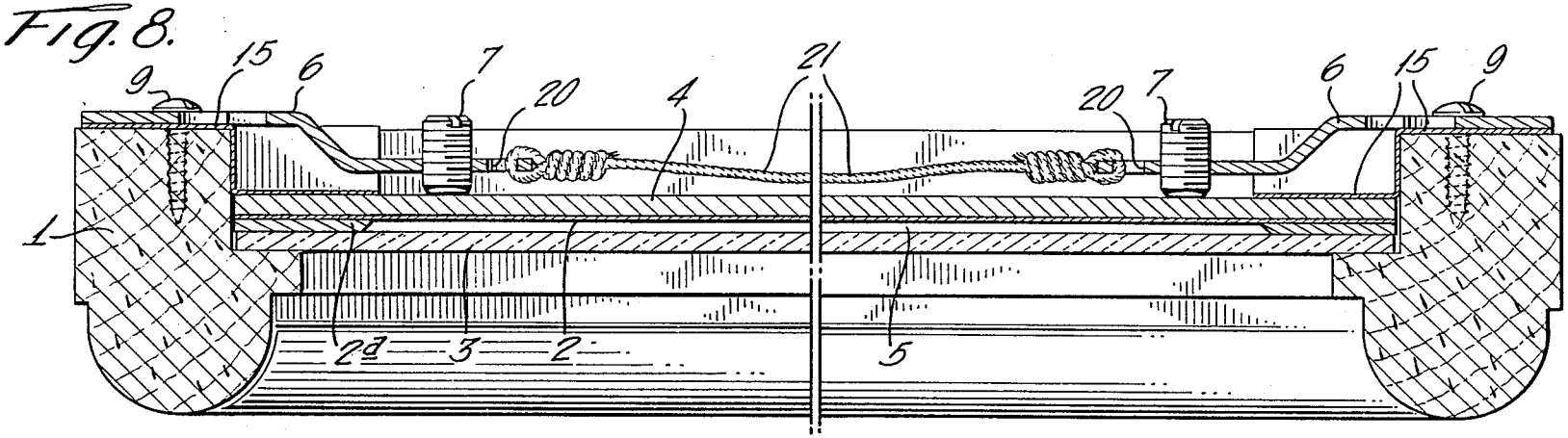
FIG. 8 is a side sectional view taken on line 8—8 of FIG. 7.
Figure 9:
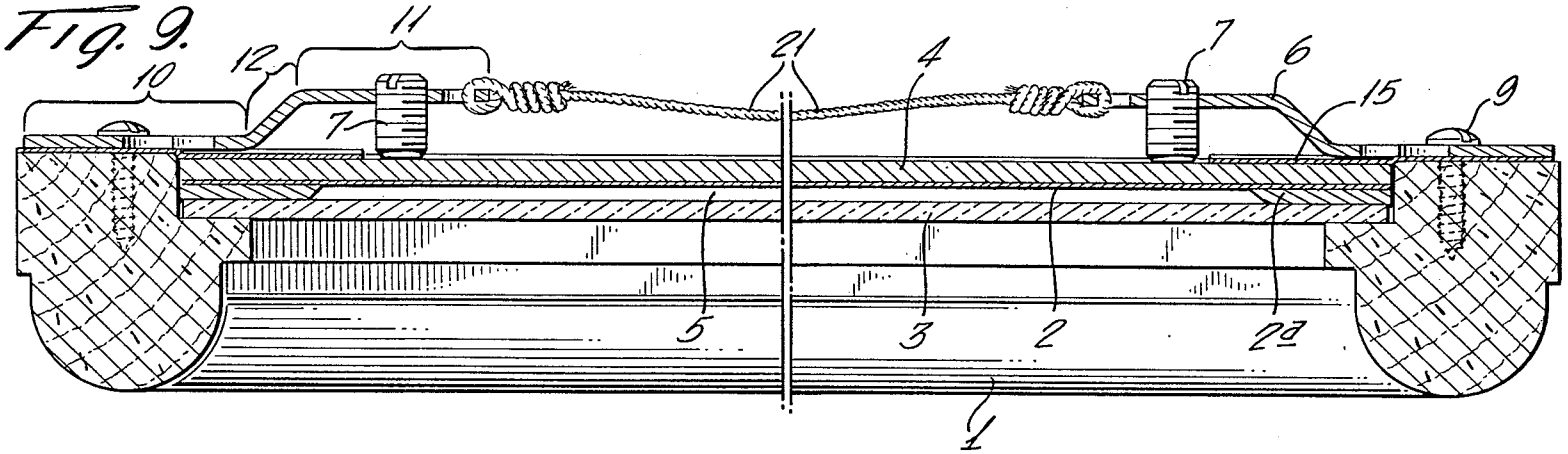
FIG. 9 is a view like FIG. 8 except that the securing member of FIG. 7 has been turned relatively upside-down in order to accommodate a different panel-frame relationship.

With reference to the figures of the drawings listed above, FIG. 1 depicts a conventional frame 1 for a decorative display 2 such as a photograph or painting. Such displays are commonly held in place by being sandwiched between a transparent protective sheet of glass or plastic and one or more rigid panels, with the transparent sheet covering, and thus protecting, the side to be displayed. This is shown in FIG. 6, which illustrates a frame 1 for displaying an article such as a photograph 2. The frame is depicted as lying face down and receiving, in order, a rigid, transparent protective sheet 3, a mat 2a for highlighting the photograph, the photograph 2, and a rigid panel 4. FIGS. 8 and 9 illustrate that in addition to highlighting the display article, the mat 2a can function to prevent the front surface of the display article from contacting the transparent sheet 3 by forming a dead air space 5 between the sheet and the display article. The inventive clamping device comprises a rigid, unitary securing member 6 and a threaded cylindrical clamping member such as a set screw 7. The securing member preferably has a triangular profile and is a metal stamping, but other shapes and suitably rigid materials may be employed for some purposes. The clamping device is attached to the raised back surface of the frame 1 by attaching means such as screws g which pass through a plurality of apertures 8 in the securing member and into the frame. The device illustrated in FIGS. 3, 4 and 5 depicts a preferred embodiment of the invention in which securing member 6 has a pair of planar portions 10 and 11 joined by a bent intermediate section 12 so that planar portions 10 and 11 reside in substantially parallel planes. Planar portion 10 contains a plurality of frame attachment apertures 8 and is attached to the frame 1 so that planar portion 11 extends over the panel 4 to be secured in the frame. Planar portion 11 contains a threaded aperture 13 for receiving the clamping means such as a set screw 7 having threads 14 that mate with the threads of aperture 13.

Figure 7:
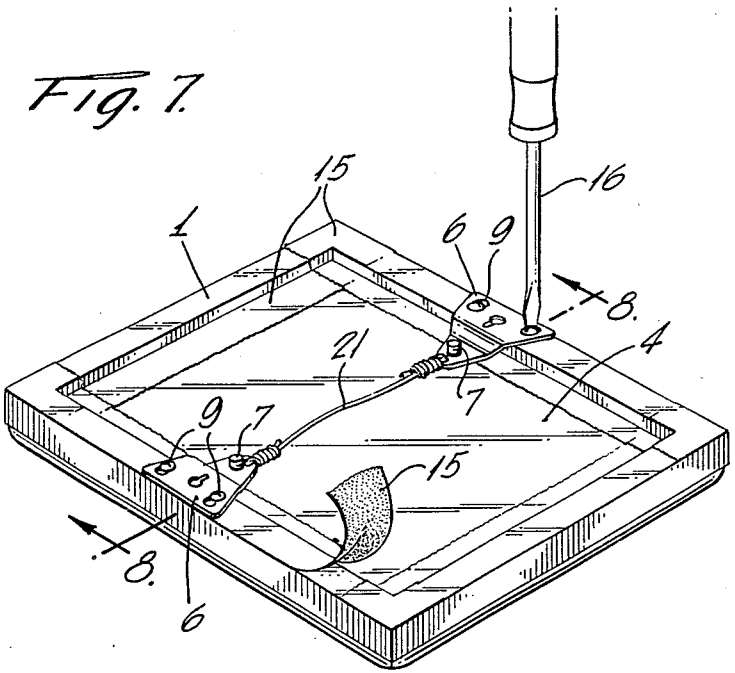
FIG. 7 depicts the components of FIG. 6 after the clamping device has been secured to the frame and the threaded clamping member has been threaded through the threaded aperture in the securing member so that it comes into contact with the panel holding the display in place.

FIG. 7 shows the components of FIG. 6 as they are being assembled, and illustrates the ease with which professional quality framing can be accomplished bY use of clamping devices incorporating principles of the invention. After all the components which are to be secured within the frame are situated therein, with the rigid panel 4 uppermost, tape 15 is preferably applied over the seam between the panel and the frame to provide security against contaminants and shifting of the display within the frame. The securing member 6 is then attached to the top surface of the frame with screws 9 which pass through the apertures 8 and into the frame. It should be appreciated that when screws and set screws are used as the attaching means and clamping means, respectively, the inventive clamp can be quickly and completely installed with an ordinary screwdriver 16.

Figure 2:
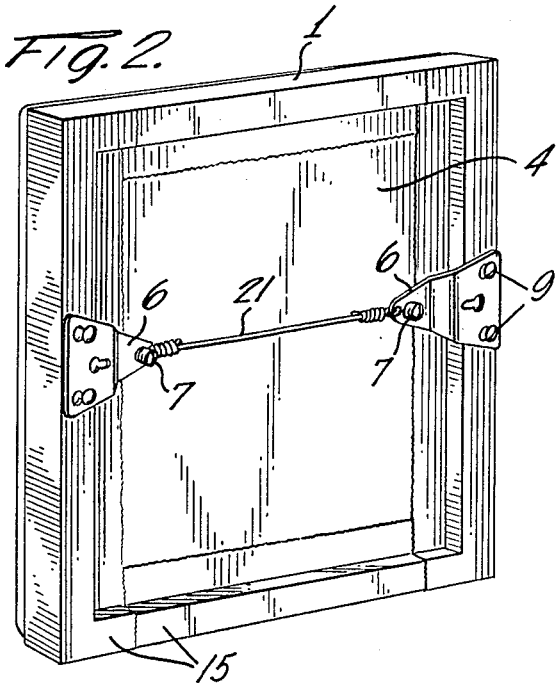
FIG. 2 is a rear view of the picture frame of FIG. 1, and shows two of the inventive clamping devices in use.

FIGS. 2, 8 and 9 show the reverse side of the frame and two right sectional views respectively, of the completely assembled structures of FIGS. 6 and 7. FIGS. 8 and 9 clearly illustrate how the clamping is accomplished by the inventive device. Once each securing member is securely attached to the frame, the clamping member, such as set screw 7, is threaded through the threaded aperture 13 until it engages the panel 4. By being threaded to a greater or lesser degree, the set screw can act to compensate for the difference in height of the panel and the top surface of the frame without adversely affecting the clamping action. This allows the present invention to exhibit great flexibility of use over a wide range of applications without the need for customization of the clamping device or the frame. Moreover, depending upon the depth of the step formed within the frame or the thickness of the assemblage of panels as is shown in FIGS. 8 and 9, securing member 6 can be inverted so that extending portion 11 resides in a plane either above (FIG. 9) or below (FIG. 8) the frame attaching portion 10. This further enables the inventive device to function equally well over a wide variety of relationships of the height of the panel relative to the upper frame surface. Although not shown in the figures, the inventive device can even be used where the top surface of the back panel 4 is higher than the top surface of the frame. In addition to the aforementioned versatility regarding the panel-frame orientation, the clamping force is also greatly adjustable. The force with which the set screw engages the panel can be readily adjusted simply by threading the set screw more or less through the threaded aperture. As is depicted in FIGS. 8 and 9, set screw 7 is threaded through aperture 13 until it makes contact with panel 4. Further threading of the set screws increases the clamping force securing panel 4 in the frame. Although other clamping means may be employed, blunt-end set screws are preferred, as they are effective to secure the panel to the frame without the use of invasive techniques. The frame attachment apertures 8 are preferably keyhole shaped so that by slightly loosening the screws 9, the entire clamping device can be easily removed by passing the wide portion of the apertures over the screw heads.

Figure 10:
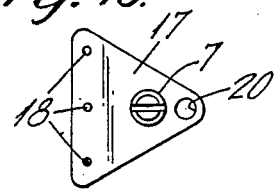
FIG. 10 is an elevational view of an alternative embodiment of the inventive clamping device.
Figure 12:
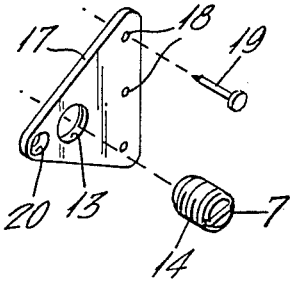
FIG. 12 is a view similar to FIG. 5 of the clamping device of FIG. 10 showing means for attaching the securing member to the frame.
Figure 13:
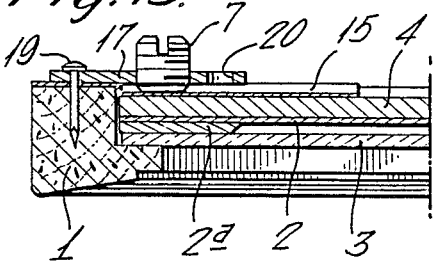
FIG. 13 is a partial side sectional view of the clamping device of FIG. 10 as it is in use in securing a panel within a frame.
Figure 11:
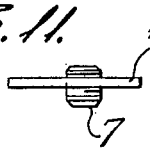
FIG. 11 is a side view of FIG. 10.

FIGS. 10—13 illustrate an alternative embodiment of the present invention in which the securing member has attaching portion 10 and extending portion 11, but in which the bent intermediate section 12 of FIG. 5 is not present. In such an embodiment, the entire securing member 17 is substantially planar. FIGS. 10 and 12 further illustrate in this alternative embodiment that the frame attachment apertures IS can be designed to receive frame attachment means such as nails 19 which are hammered into the frame rather than screwed in as with screws 9. This embodiment is particularly well suited for use on narrow frames, as the use of small nails rather than screws would be less likely to result in the frame splitting. FIGS. 10 and 12 additionally show that the frame attachment apertures can be arranged linearly, allowing the use of three or more attaching means with narrow frames.

Both embodiments of the inventive device are shown as further containing an aperture 20 in the extending portion 11. This aperture maY be employed to attach a wire or cord 21 between oppositely oriented clamping devices, so that the cord can be used to support the entire frame. This is especially useful when the invention is used on ornamental display frames which are hung on walls. It is preferred that aperture 20 be present in the invention, but it could be eliminated if the frame were provided with alternative means of support.

The inventive clamping devices may be attached to the frame at any point able to receive the frame attaching means, and any number of clamping devices may be used. FIGS. 6 and 7 show a preferred embodiment of the invention in which two clamping devices are attached to the frame at equal positions on the frame opposite each other. Although more clamps can be used for greater security, particularly for larger frames, two clamps will be adequate for small to medium sized frames, and can very quickly and easily be attached or removed. Oppositely oriented clamps facilitate the use of hanging means attached to the additional apertures 20, and also provide for even distribution of the clamping force provided by the individual units. As the Figures illustrate, the inventive clamping device can be used on conventional frames without the need for any modifications to the frame or panel secured therein, and can be installed quickly and easily without the need for special equipment or tools.

What is claimed is:

1. In a clamping device for securing a removable panel to a frame wherein the frame has first and second substantially parallel planar surfaces, one of said surfaces being offset with respect to the other surface, said clamping device comprising a unitary, rigid planar securing member having a substantially triangular profile, said securing member having an elongated base portion with an elongated base edge having base ends and a planar apex portion, said securing member having frame attaching apertures spaced lengthwise of said base edge for attachment of the planar securing member to the first of said planar frame surfaces with the apex portion overlying the second of said planar frame surfaces, in spaced relation to said second planar frame surface and to a removable panel supported on said surface, a threaded aperture extending through said apex portion, a threaded set screw threadedly received within said threaded aperture for engagement with a removable panel on said second planar frame surface in frictional contact with the panel with a constant pressure, and a wire attaching aperture within said apex portion.

2. In a clamping device for securing a removable panel to a frame member wherein the frame has first and second substantially parallel planar surfaces, said surfaces being in planes which are offset with respect to each other, said clamping device comprising a unitary, rigid securing member having a substantially triangular profile, said securing member having an elongated base portion with an elongated base edge having base ends and a planar apex portion, said base and said apex portions being offset from one another in substantially parallel planes, a bent intermediate section integrally joined to said base and apex portions, said securing member having frame attaching apertures spaced lengthwise of said base edge for attachment of the planar securing member to the first of said planar frame surfaces with the apex portion overlying the second of said planar frame surfaces, in spaced relation to said second planar frame surface and to a removable panel supported on said surface, a threaded aperture extending through said apex portion, a threaded set screw threadedly received within said threaded aperture for engagement with a removable panel on said second planar frame surface in frictional contact with the panel with a constant pressure, said bent intermediate section allowing for attachment of the base portion of the clamping device to the first frame surface alternately with the apex portion below the level of the base portion or above the level of the base portion to allow for a range of differences in dimensions of the frame and the removable panel, and a wire attaching aperture within said apex portion.

* * * * *

UNITED STATES PATENT AND TRADEMARK OFFICE

CERTIFICATE OF CORRECTION

PATENT NO. : 4,932,146

DATED : June 12, 1990

INVENTOR(S) : M. Thomas Long

It is certified that error appears in the above-identified patent and that said Letters Patent is hereby corrected as shown below:

Column 3, line 14, "screws g" should be --screws 9--

Column 3, line 30, "bY" should be --by--

Column 4, line 27, "IS" should be --18--

Column 4, line 39, "maY" should be --may--

Signed and Sealed this

Twenty-ninth Day of October, 1991

*Attest:*

HARRY F. MANBECK, JR.

*Attesting Officer*

*Commissioner of Patents and Trademarks*